US007669664B2

(12) United States Patent
McGarian et al.

(10) Patent No.: US 7,669,664 B2
(45) Date of Patent: Mar. 2, 2010

(54) APPARATUS AND METHOD FOR OPENING AND CLOSING LATERAL BOREHOLES

(75) Inventors: Bruce McGarian, Aberdeen (GB); Anthony Laplante, Aberdeen (GB); Ian A. Gillies, Angus (GB); Terence Johnston, Aberdeen (GB)

(73) Assignee: Smith International, Inc., Houston, TX (US)

( * ) Notice: Subject to any disclaimer, the term of this patent is extended or adjusted under 35 U.S.C. 154(b) by 469 days.

(21) Appl. No.: 10/530,486

(22) PCT Filed: Dec. 2, 2003

(86) PCT No.: PCT/GB03/05201

§ 371 (c)(1),
(2), (4) Date: Jun. 2, 2005

(87) PCT Pub. No.: WO2004/051053

PCT Pub. Date: Jun. 17, 2004

(65) Prior Publication Data

US 2005/0230151 A1 Oct. 20, 2005

(30) Foreign Application Priority Data

Dec. 2, 2002 (GB) ..... 0228064.2

(51) Int. Cl.
*E21B 23/00* (2006.01)

(52) U.S. Cl. ..... 166/382; 166/117.5; 166/332.2; 166/332.4

(58) Field of Classification Search ..... 166/50, 166/117.5, 117.6, 331, 332.2, 334.2, 382, 166/386; 175/61, 80

See application file for complete search history.

(56) References Cited

U.S. PATENT DOCUMENTS

| | | | | |
|---|---|---|---|---|
| 3,826,309 | A | 7/1974 | Tausch | |
| 4,378,842 | A | 4/1983 | Patel | |
| 4,574,889 | A | 3/1986 | Pringle | |
| 4,791,991 | A | 12/1988 | Morris et al. | |
| 4,834,183 | A | 5/1989 | Vinzant et al. | |
| 5,415,237 | A | 5/1995 | Strattan | |
| 5,458,209 | A * | 10/1995 | Hayes et al. | 175/61 |
| 5,520,250 | A | 5/1996 | Harry et al. | |
| 5,730,224 | A | 3/1998 | Williamson et al. | |

(Continued)

*Primary Examiner*—Jennifer H Gay
*Assistant Examiner*—David Andrews
(74) *Attorney, Agent, or Firm*—Dykema Gossett PLLC

(57) ABSTRACT

The present invention relates to a downhole tool (102) for selectively opening and closing a lateral borehole extending from a primary borehole. The tool (102) comprises a body (104) incorporating a wall provided with an opening (116) extending therethrough; a deflector member (106) slidably mounted in the body (104) and having a deflecting surface (126) for deflecting, in use, downhole equipment laterally within the body (104). The deflector member (106) is slidable between an open position, in which the deflecting surface is located adjacent and facing towards said opening so that, in use, downhole equipment laterally deflected by the deflecting surface is directed through said opening, and a closed position, in which the deflecting surface is oriented relative to said opening so as to prevent downhole equipment from being laterally deflected through said opening during use. In either position, equipment may pass into the primary borehole downhole of the primary/lateral junction. The tool (102) also comprises constraining means (138, 140) for restricting movement of the whipstock relative to the body.

14 Claims, 15 Drawing Sheets

U.S. PATENT DOCUMENTS 5,787,987 A 8/1998 Forsyth et al.
6,053,254 A 4/2000 Gano
6,089,320 A * 7/2000 LaGrange ..... 166/313
6,834,722 B2 12/2004 Vacik et al.
7,207,390 B1 * 4/2007 Pratt ..... 166/313
2004/0011529 A1 1/2004 McGarian et al.

* cited by examiner

Running in Hole

Running into Hole Circumferential

Snapping into Circumferential Groove

Straight Pull for Upward Activation

Flow Rate -> Static Pressure for Pump Down Activation

APPARATUS AND METHOD FOR OPENING AND CLOSING LATERAL BOREHOLES

BACKGROUND OF THE INVENTION

1. Field of the Invention

The present invention relates to a method and apparatus for opening and closing lateral boreholes and particularly, but not exclusively, to a method and apparatus for selectively opening and sealingly closing a lateral borehole.

2. The Prior Art

It is well known in the oil and gas drilling industries to provide a primary borehole with one or more lateral boreholes. The deflection of downhole equipment from the primary borehole into a lateral borehole may be readily achieved through location of a deflector/whipstock downhole of the primary/lateral borehole junction. It is also known for the types of deflector/whipstock used in this manner to be provided with an axially extending bore for allowing access to the portion of primary borehole located downhole of said junction. In this way, use of the primary borehole or an associated lateral borehole may be selected. However, if use of the lateral borehole is no longer required or not required for considerably long periods of time, then it can be desirable to close the opening in the primary borehole which extends into the lateral borehole. However, closing the opening in the primary borehole requires removal of the deflector so that specialist closing equipment can be employed. This is time consuming, costly and inconvenient.

It is an object of the present invention to provide a method and apparatus for controlling access to a lateral borehole.

SUMMARY OF THE INVENTION

A first aspect of the present invention provides a downhole deflector tool for selectively opening and closing a lateral borehole extending from a primary borehole, the downhole tool comprising a body incorporating a wall provided with an opening extending therethrough; a deflector member slidably mounted in the body and having a deflecting surface for deflecting, in use, downhole equipment laterally within the body, the deflector member being slidable between an open position, in which the deflecting surface is located adjacent and facing towards said opening so that, in use, downhole equipment laterally deflected by the deflecting surface is directed through said opening, and a closed position, in which the deflecting surface is oriented relative to said opening so as to prevent downhole equipment from being laterally deflected through said opening during use; and constraining means for restricting movement of the deflector member relative to the body.

Thus, in circumstances where use of both a primary borehole and a lateral borehole is required, the deflector member of the present invention may be located in an open position so that the deflecting surface may deflect equipment laterally through said opening and into an adjacent lateral borehole. If, however, use of only the primary borehole is required, then the opening may be closed by moving the deflector member into a closed position.

Ideally, the constraining means comprises a pin and groove arrangement. At least one pin may be secured to one of the body and deflector member for locating in a groove defined in the other of the body and deflector member. The pin and groove arrangement is preferably such that the deflector member must move axially between two different closed positions before being able to move axially to the open position. The constraining means may also comprise a shoulder defined by the body. The deflector member may abut the shoulder when in the open position.

The downhole tool of the present invention may also comprise means for allowing axial movement of the deflector member by the action of fluid pressure. A bore preferably extends axially through the deflector member. Furthermore, it is preferable for the bore extending axially through the deflector member to comprise first and second portions, the first portion having a larger diameter than the second portion. The deflecting surface may be defined on that portion of the deflector member reducing the diameter of the bore through the deflector member.

It is particularly preferable for sealing means to be provided between the body and deflector member so that, when in the closed position, fluid located to the exterior of the body is prevented from flowing into the bore of the deflector member. The sealing means may comprise seals mounted on the deflector member and axially spaced from one another so as to be locatable beyond each axial end of said opening In the closed position, it is preferable for the deflecting surface of the deflector member to face diametrically away from said opening. Also, in the closed position, it is preferable for said opening to be completely covered by the deflector member. Also, when in the closed position, the deflecting surface may be axially spaced from said opening. Ideally, the wall of said tool body defines an axially extending bore in which the deflector member is slidably mounted.

A second aspect of the present invention provides a method of using a downhole tool in accordance with the first aspect of the present invention, the method comprising the steps of running said tool down a primary borehole, aligning said opening of said tool body with a lateral borehole extending from said primary borehole, and selectively moving said deflector member between said open and closed positions.

The step of moving said deflector member may comprise the step of applying a fluid pressure to said deflector member. Alternatively, said step of moving said deflector member may comprise the step of engaging said deflector member with a further tool and manipulating said deflector member with said further tool.

It will be appreciated that the present invention provides the advantage over the prior art of allowing a lateral opening to be conveniently opened and closed.

A third aspect of the present invention provides a downhole deflector tool as referred to above and a downhole manipulation tool comprising a generally cylindrical body having a bore axially extending therethrough and a vent aperture laterally extending therethrough so as to allow fluid communication between the bore of the manipulation tool and the exterior thereof; the manipulation tool further comprising a piston movable within the bore of the manipulation tool between a first position, in which the vent aperture is closed, and a second position, in which the vent aperture is open and the bore of the manipulation tool is blocked so that, in use, all fluid flowing through the bore of the manipulation tool is directed through the vent aperture.

The manipulation tool may be provided with a plurality of vent apertures. Also, the body of the manipulation tool may be provided with means for connecting the manipulation tool to the deflector member of said downhole deflector tool. The bore of the deflector member is ideally provided with a circumferential groove and the body of the manipulation tool is provided with a collett for engaging with said circumferential groove.

Sealing means may also be provided for preventing a flow of fluid between the body of the manipulation tool and said downhole deflector tool when, in use, said tools are connected to one another. Furthermore, biasing means may be provided in the manipulation tool for biasing said piston towards the first position.

A fourth aspect of the present invention provides a method of using the aforementioned downhole deflector tool and manipulation tool, the method comprising the steps of running the downhole deflector tool down a primary borehole, aligning said opening of the body of the downhole deflector tool with a lateral borehole extending from said primary borehole, running the downhole manipulation tool down said primary borehole, and applying fluid pressure to the manipulation tool so as to move the piston of the manipulation tool from the first position to the second position whilst the body of the manipulation tool is engaged with the deflector member of the downhole deflector tool.

It will be understood that, in moving the piston of the manipulation tool from the first position to the second position, all wellbore fluid flowing downhole through the apparatus will be directed through the or each vent aperture and into the annulus surrounding the manipulation tool. The fluid in the manipulation tool and in said annulus above the deflector member may be pressurised so as to apply sufficient force to both the manipulation tool and the deflector member so as to move these components axially downhole relative to the body of the deflector tool. In essence, the manipulation tool and deflector member co-operate to act as a piston axially movable by means of fluid pressure. The downhole manipulation tool may be run down said primary borehole whilst engaged with the downhole deflector tool. Also, when the piston of the manipulation tool is in the second position, sufficient fluid pressure is generated in the bore of the manipulation tool and exteriorly of the manipulation tool to move downhole the manipulation tool and deflector member engaged therewith. The method may further comprise the step of picking up the manipulation tool and moving uphole the manipulation tool and deflector member engaged therewith.

Before the step of applying fluid pressure, a second lateral borehole extending from said primary borehole at a location uphole of the first lateral borehole may be sealed against an ingress of fluid from said primary borehole. The step of sealing said second lateral borehole may comprise the aforementioned methods of using the downhole deflector tool and said tool in combination with the manipulation tool.

A fifth aspect of the present invention provides a downhole deflector member comprising a cylinder having a window provided in a side thereof and having a ramp defined on an interior surface thereof for deflecting, in use, downhole equipment through said window; wherein a bore extends longitudinally through the deflector member so as to allow, in use, a passage of downhole equipment through the deflector member without deflection by said ramp; and wherein a portion of said bore located uphole of said ramp has a larger diameter than the remainder of said bore.

A deflector member in accordance with the third aspect of the present invention may be used in conjunction with an expandable head tool to selectively deflect downhole equipment through a window in said deflector member and into an adjacent lateral borehole. The bore extending longitudinally through the deflector member allows downhole equipment to be run through the deflector member past the ramp to the primary borehole located downhole of the primary/lateral junction. It will be understood that, in order for downhole equipment to pass the ramp without being deflected, said equipment must have an external diameter no greater than the diameter of the deflector member bore. However, downhole equipment provided with an expandable head tool may be not only run past the ramp into the primary borehole located below the primary/lateral junction, but may be optionally deflected by the ramp through the window into a lateral borehole by expanding the expandable head tool whilst said tool is located in said portion of bore having an enlarged diameter. In so increasing the external diameter of said tool, the downhole equipment adopts an external diameter greater than the diameter of the bore extending past the ramp. Accordingly, with the expandable head tool in an expanded configuration, the downhole equipment is unable to pass the ramp and, when pressed downhole through the deflector member, comes into contact with the ramp and is thus deflected by the ramp into the window.

Ideally, the remainder of said bore is located both uphole and downhole of said portion of said bore. Thus, with smaller diameter portions of bore being located either side of the enlarged diameter portion of bore, downhole equipment to be run past the lateral window without deflection may be guided past the enlarged diameter bore by the smaller diameter portion of bore located uphole thereof. In other words, with the uphole and downhole portions of the smaller diameter bore being located co-axially with each other, the uphole portion of bore effectively aligns equipment with the downhole portion of bore and thereby guides equipment into the downhole portion of bore and minimizes the risk of said equipment being deflected by the ramp.

A sixth aspect of the present invention provides a method of using the deflector member of the third aspect of the present invention, the method comprising the steps of running an expandable head tool downhole into the deflector member; expanding said tool so as to increase the diameter thereof and thereby prevent passage of said tool through the remainder of said bore; and pressing said tool downhole so that said tool is deflected by said ramp.

Embodiments of the present invention will now be described, by way of example only, with reference to the accompanying drawings.

BRIEF DESCRIPTION OF THE DRAWINGS

FIG. 5A is a diagrammatic representation of the position of the pin in the groove in the open configuration of FIG. 5;

FIG. 5B is a cross-section through the embodiment of FIG. 5 at a first position along the tool;

FIG. 5C is a cross-section through the embodiment of FIG. 5 at a second position along the tool;

FIG. 5D is a cross-section through the embodiment of FIG. 5 at a third position along the tool;

DETAILED DESCRIPTION OF THE PREFERRED EMBODIMENTS

Figure 1A:
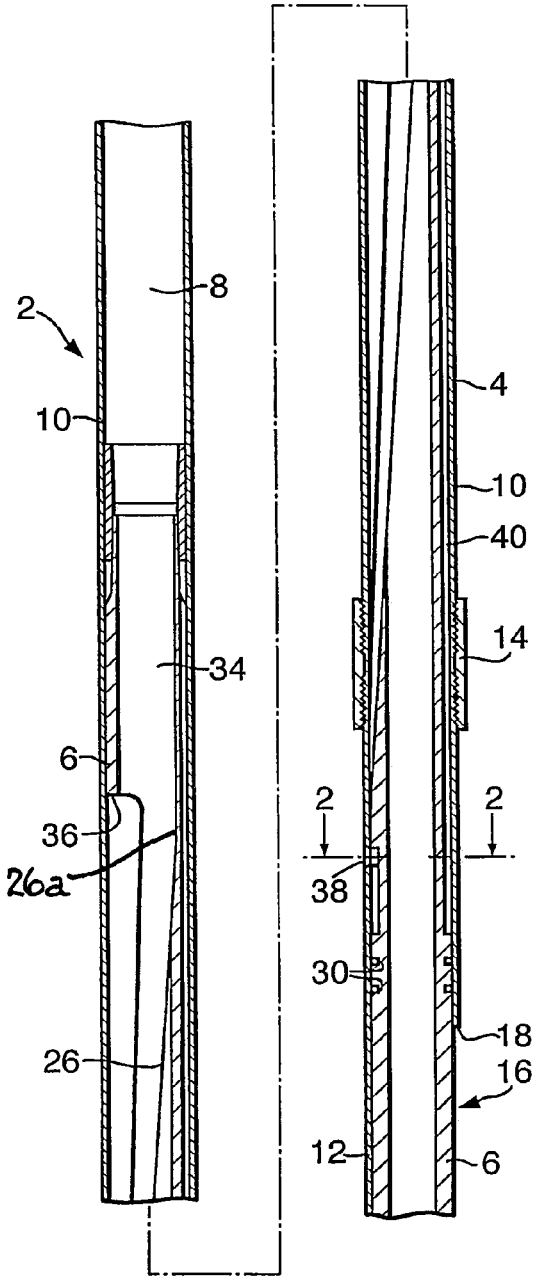
FIGS. 1A and 1B provide a cross-sectional side view of a first embodiment of the present invention arranged in a closed configuration.
Figure 2:
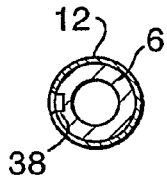
FIG. 2 is a cross-sectional end view taken along line 2-2 of FIG. 1A.

A first downhole tool 2 according to the present invention is shown in FIGS. 1 to 4 of the accompanying drawings. The tool 2 comprises a body member 4 in which a whipstock or deflector member 6 is located. The body member 4 has a generally cylindrical shape with a longitudinal bore 8 extending therethrough. The body member 4 comprises an upper cylindrical portion 10 which is threadedly connected to a window portion 12 of the body member 4 by virtue of a threaded collar 14. The window portion 12 has a cylindrical shape with a lateral window or opening 16 defined in the side thereof for alignment, in use, with a lateral borehole. Upper and lower edges of the window 16 are clearly visible in FIGS. 1 and 4 of the accompanying drawings. The body member 4 also comprises a lower cylindrical portion 22 threadedly attached to a lower end of the window portion 12. The lower cylindrical portion 22 comprises an upwardly facing shoulder 24 which projects radially into the bore 8 of the body member 4. Each of the body portions 10, 12, 22 define a portion of the body bore 8. The body member may be alternatively made up of components which are connected to one another by means other than threaded connectors. Body components may, for example, be welded to one another.

The deflector member 6 is slidably mounted in the bore 8 of the body member 4. The deflector member 6 comprises an upper portion upon which a deflecting surface 26 is defined and a lower cylindrical portion 28. The lower cylindrical portion 28 is sufficiently long to extend across the full length of the lateral window 16. A pair of O-ring seals 30,32 are located at opposite ends of the lower portion 28. The positioning of the O-ring seals 30,32 is such that, with the lower cylindrical portion 28 spanning the lateral window 16, the two pairs of seals 30,32 may locate either side of the lateral window 16 so that, in use, wellbore fluid flowing into any space between the exterior of the lower portion 28 and the interior of the window portion 12 cannot flow into a bore 34 extending axially through the deflector member 6. Any suitable seals may be used as an alternative to the O-ring seals 30, 32.

The internal diameter of the deflector bore 34 reduces in the region of the upper portion of the deflector member 6. In this way, the deflecting surface 26 is defined as a ridge running axially up along the inside of the deflector bore 34 to a base 26*a*. In use, downhole equipment having an outer diameter smaller than the larger internal diameter of the deflector bore 34 may be run into the deflector member 6. If this downhole equipment has an outer diameter greater than the reduced internal diameter of the deflector bore 34 however, said equipment will engage the deflecting surface 26 and be pressed laterally towards the side of the tool 2. The wall of the deflector member 6 diametrically opposite the deflecting surface 26 is provided with an elongate opening 36 which has approximately the same size and shape as the lateral window 16. Thus, through appropriate use of the tool 2, the opening 36 may be aligned with the lateral window 16 so that downhole equipment engaging the deflecting surface 26 may be pressed through the lateral window 16 and into an adjacent lateral wellbore.

Figure 3:
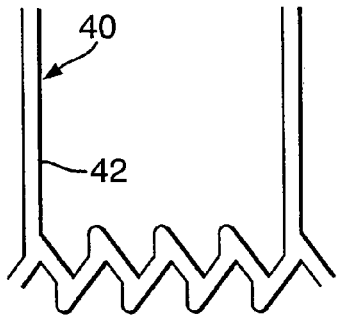
FIG. 3 is an unwrapped view of the control groove shown in FIG. 1A.

Movement of the deflector member 6 within the body member 4 is achieved in use through the action of a suitable hydraulic actuator (not shown) connected to the deflector member. This movement of the deflector member 6 is restricted by a control pin 38 and groove 40 arrangement. The control pin 38 is fixedly secured to the window portion 12 of the body member 4 so as to extend radially into the body bore 8 and thereby locate in the control groove 40 which is defined in the exterior surface of the deflector member 6. More specifically, the control pin 38 is fixed to the window portion 12 above the lateral window 16. The unwrapped profile of the control groove 40 is shown in FIG. 3 of the accompanying drawings.

Figure 1B:
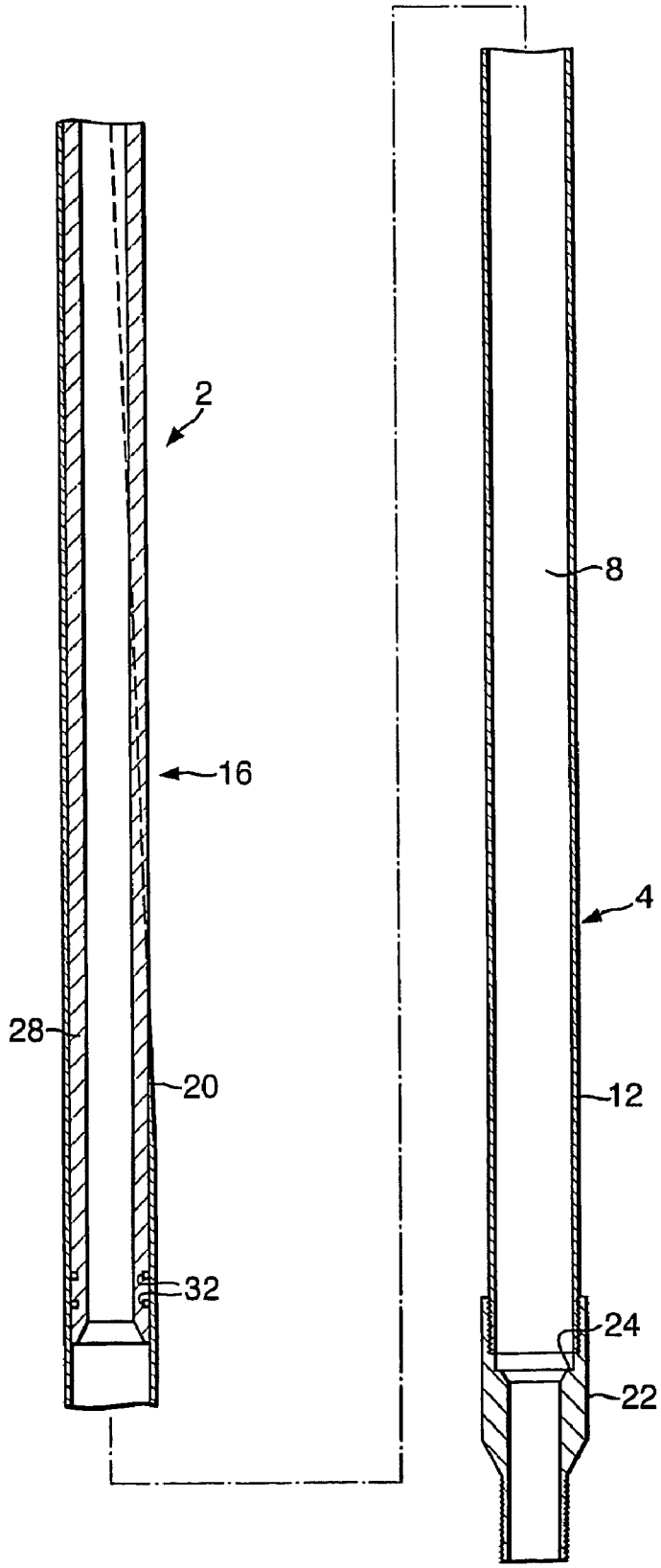
Figure 4A:
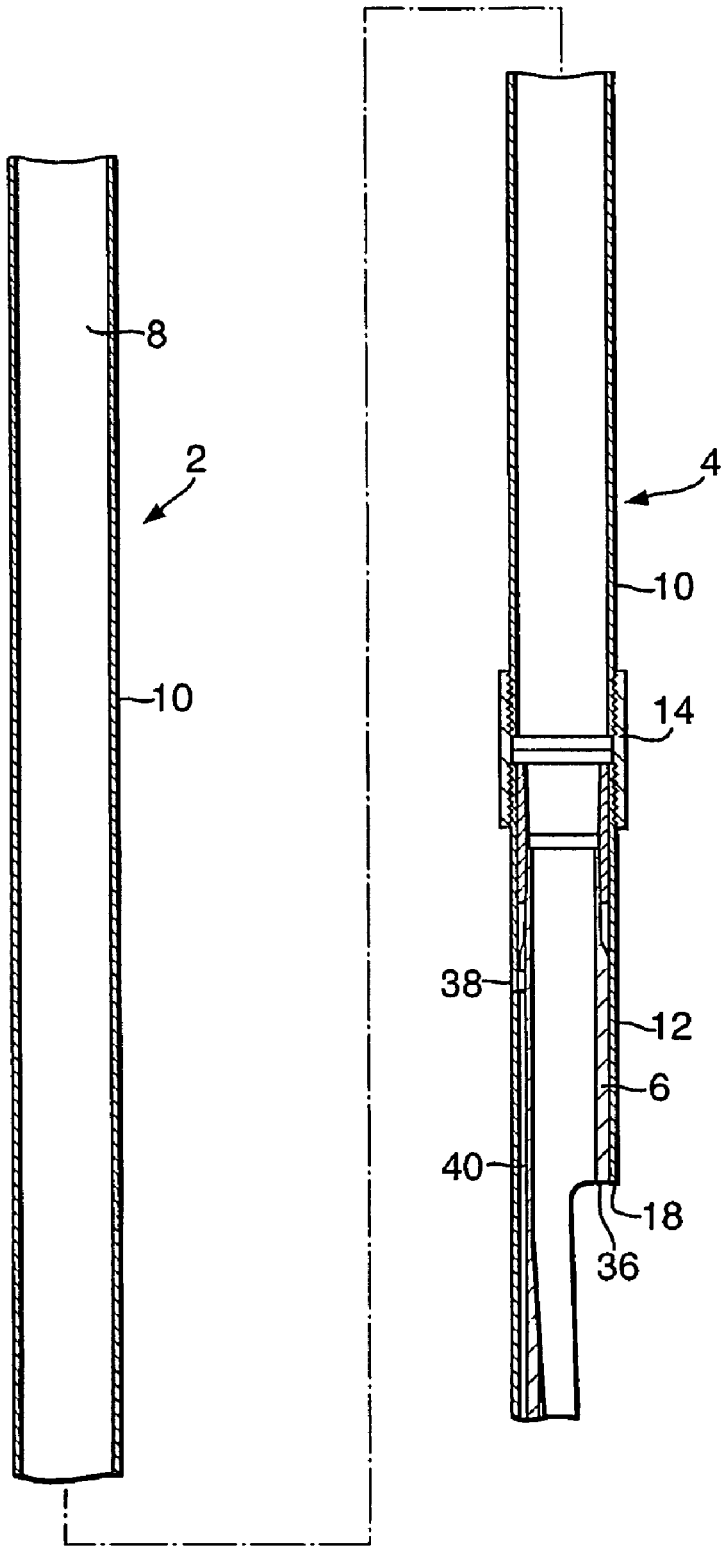
FIGS. 4A and 4B provide a cross-sectional side view of the first embodiment arranged in an open configuration.
Figure 4B:
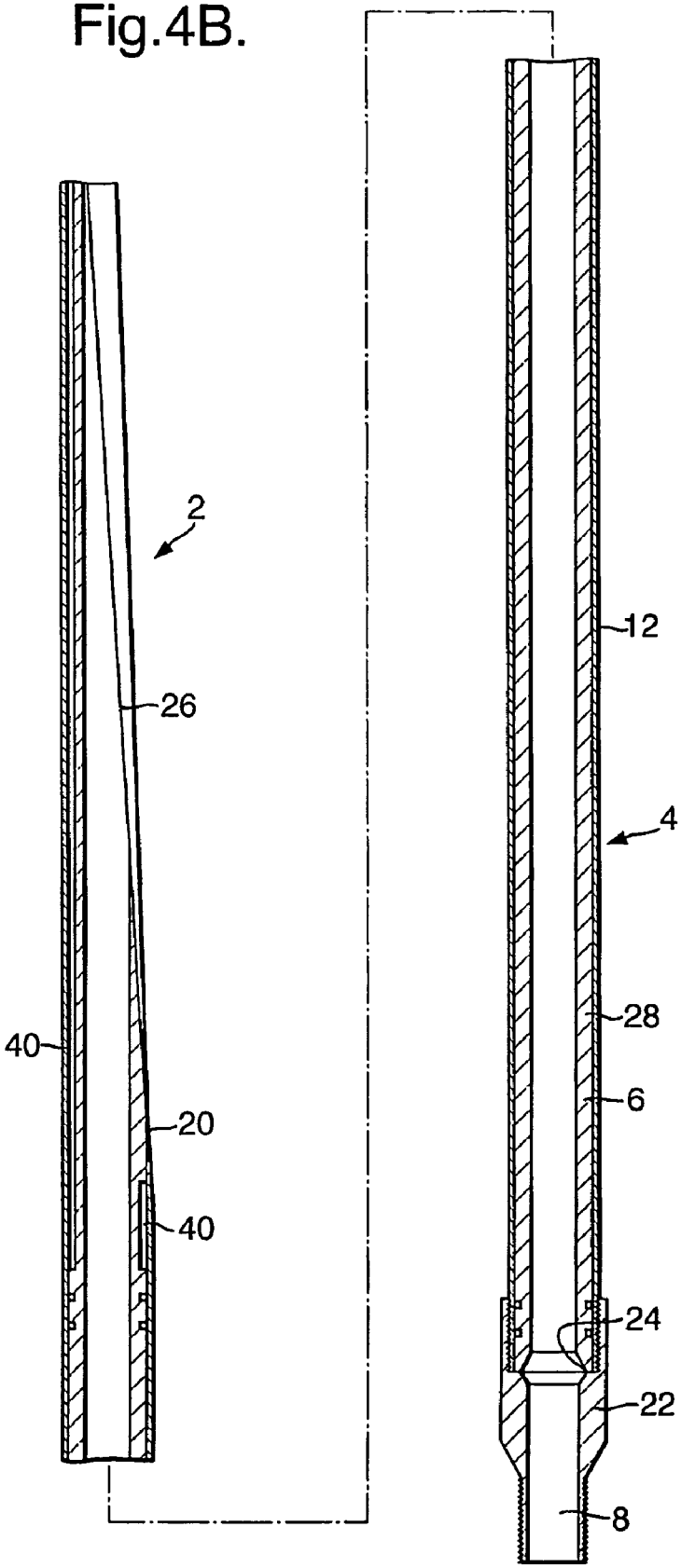

It will be understood by those skilled in the art that the control groove 40 constrains the deflector member 6 to cycle axially between first and second positions in which the lateral window 16 is closed and sealed by the lower portion 28 and the seals 30, 32. After the deflector member 6 has been cycled a predetermined number of times, the control pin 38 will locate in an axially extended portion 42 of the control groove 40. With the control pin 38 so located, the deflector member 6 may be moved a considerable axial distance within the body member 4 so that the deflecting surface 26, previously located above the lateral window 16 (see FIGS. 1A and 1B), is located adjacent the lateral window 16 (see FIGS. 4A and 4B). In this latter position, the lower cylindrical portion 28 of the deflector member 6 is located below the lateral window 16 and abuts the shoulder 24. Abutment of the deflector member 6 with the shoulder 24 avoids damaging the control pin 38 on the extended portion 42 of the groove 40. It will be appreciated that the arrangement of the control groove 40 ensures that, when the pin 38 is in the extended groove portion 42, the deflector member 6 is in a rotary position whereby the deflecting surface 26 faces the lateral window 16 so that downhole equipment may be deflected through said window 16. As such, the deflector member 6 as shown in FIGS. 1A and 1B may be considered as being in a closed position, whereas the deflector member 6 as shown in FIGS. 4A and 4B may be considered as being in an open position.

The tool 2 shown in FIGS. 1 to 4 is moved between closed and open configurations by pumping wellbore fluid to a hydraulic actuator so as to cycle the control pin 38 through the control groove 40. The actuator may comprise a motor which drives the deflector member by means of a suitable gear mechanism. Furthermore, the actuator used with the tool 2 of FIGS. 1 to 4 need only drive the deflector member axially uphole and downhole. Provided the connection between the actuator and deflector member allows rotation between the two components, the control pin and groove arrangement will translate axial movement of the deflector member into rotational movement thereof. Alternatively, movement of the deflector member 6 may be achieved through mechanical manipulation thereof. The deflector member 6 may be physically forced uphole and downhole, as appropriate, with the control pin and groove arrangement being relied upon to rotate the deflector member 6. If the actuator moves the deflector member both axially and rotationally, then the pin and groove arrangement may be omitted (movement of the deflector member between open and closed positions then being controlled solely by the actuator).

Figure 5:
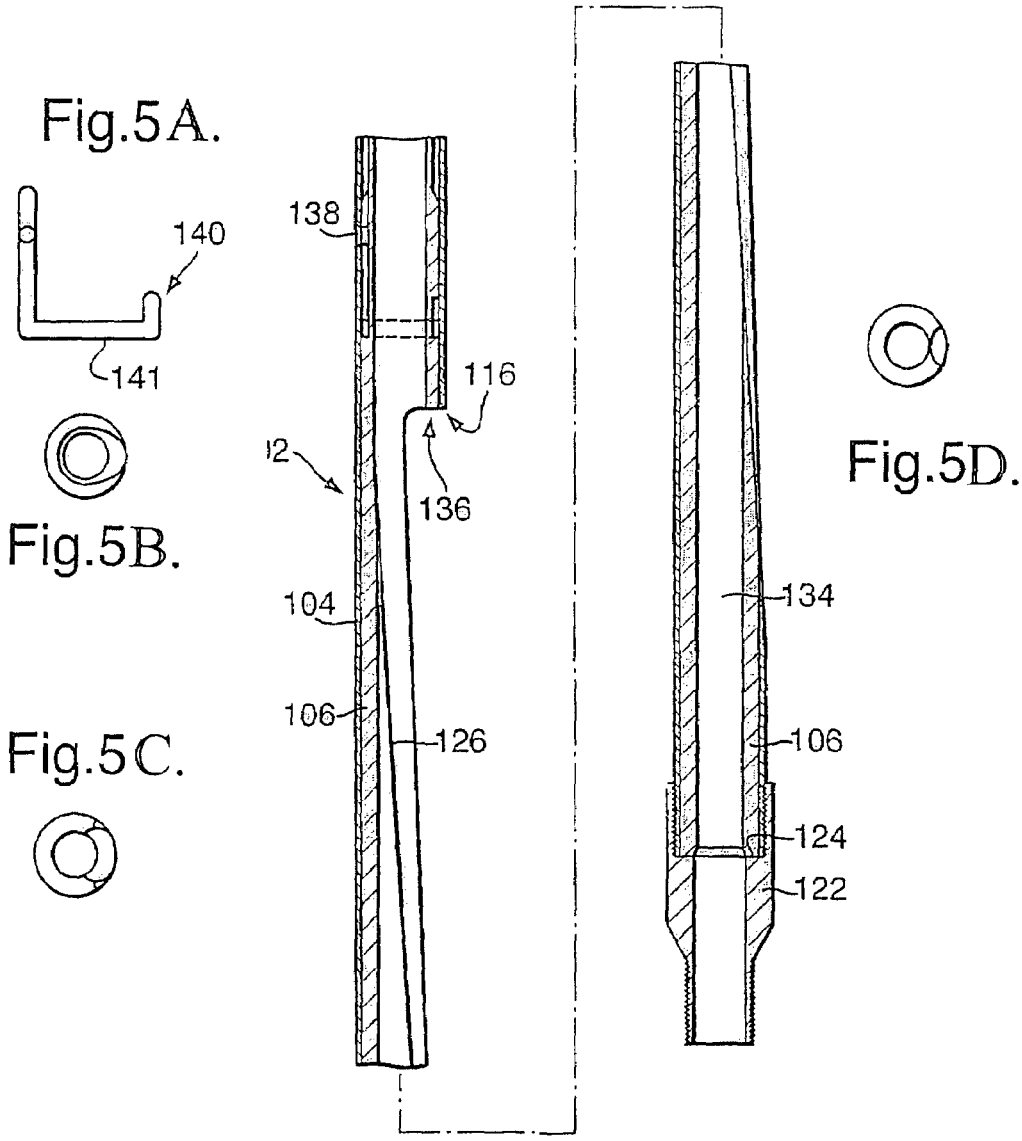
FIG. 5 is a cross-sectional side view of a second embodiment of the present invention arranged in an open configuration.
Figures 6, 6A:
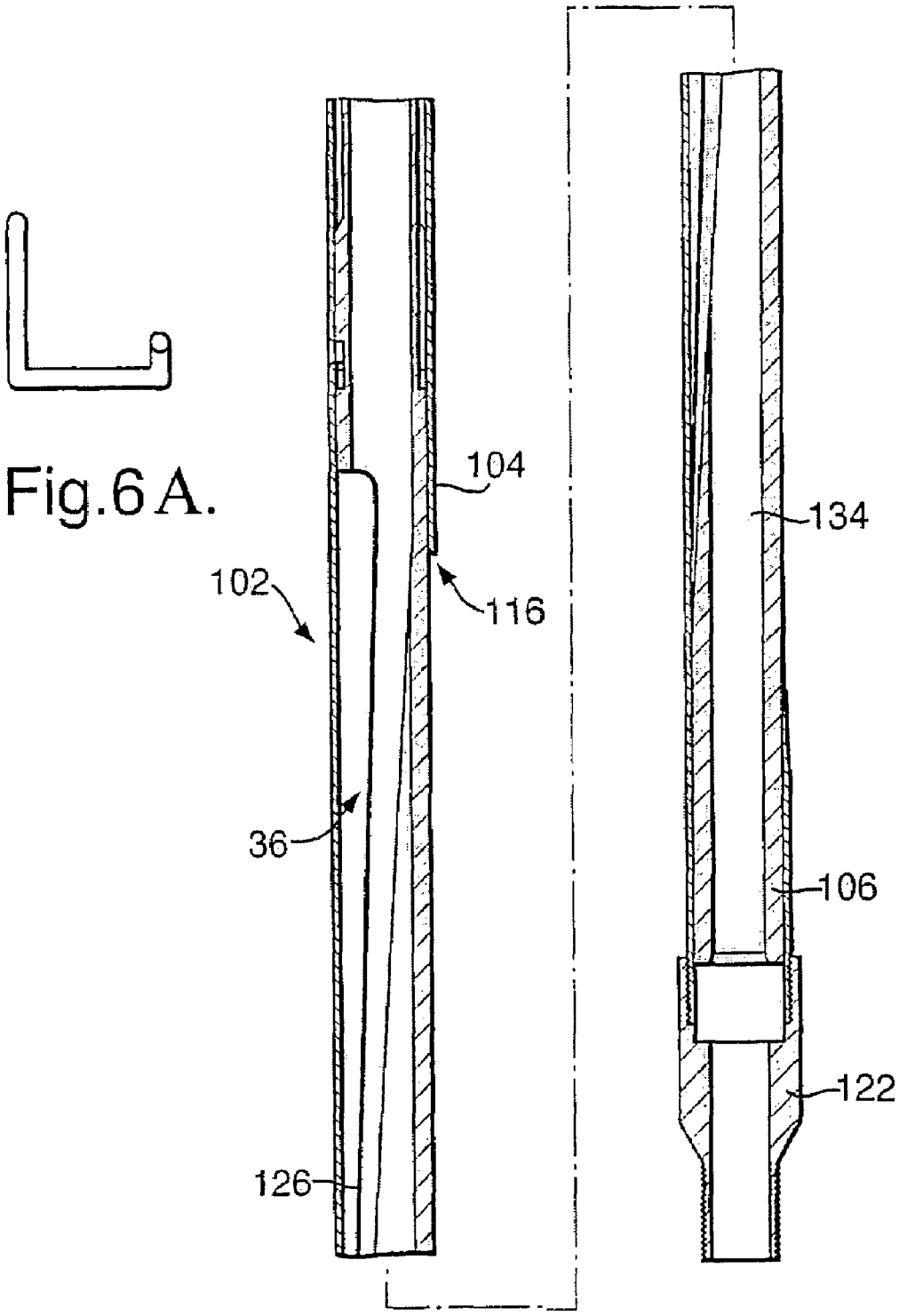
FIG. 6 is a cross-sectional side view of the second embodiment arranged in a closed configuration.
FIG. 6A is a diagrammatic representation of the position of the pin in the groove when the tool is in the closed configuration of FIG. 6.

In FIGS. 5 and 6 of the accompanying drawings, a second downhole tool 102 according to the present invention is illustrated wherein movement of a deflector member 106 relative to a body member 104 is achieved through physical manipulation of the deflector member 106 by means of an extrinsic gripping tool (not shown). Movement of the deflector member 106 relative to the body member 104 is nevertheless controlled by means of a control pin 138 and groove 140 arrangement. However the groove 140 comprises a portion 141 which extends circumferentially without any axial component and, accordingly, the application of simply an axial force to the deflector member 106 will not effect movement of the control pin 138 along the aforesaid control groove portion 141. Movement of the control pin 138 along the aforesaid control groove portion 141 corresponds to a rotary movement of the deflector member 106 within the body member 104 without any concurrent axial movement of the deflector member 106. This sole rotary movement of the deflector member 106 is achieved through manipulation with the aforementioned extrinsic tool. This type of control pin/groove arrangement may replace the cycling pin/groove arrangement in the first downhole tool 2.

In addition to having a different pin/groove arrangement to that of the first downhole tool 2, the second tool 102 has the further modification of comprising a deflector member 106 which does not incorporate a lower cylindrical portion 28. The deflector member 106 of the second tool 102 also does not comprise any seals. In the open position, a deflecting surface 126 of the deflector member 106 is arranged so as to face the lateral window 116 defined in the body member 104. The opening 136 of the deflector member 106 is also aligned with the lateral window 116. The open configuration of the second downhole tool 102 is shown in FIG. 5 of the accompanying drawings. It will be seen with reference to this Figure that undue pressure on the control pin 138 is prevented by the abutment of the deflector member 6 with a shoulder 124 on a lower body portion 122.

In the closed configuration as illustrated in FIG. 6 of the accompanying drawings, the deflector member is rotated 180° from the open position. The deflector surface 126 therefore faces away from the lateral window 116 and a part-cylindrical portion of the deflector member 106 spans the lateral window 116. The lateral window 116 is thereby closed. However, due to the absence of appropriate seals, wellbore fluid may in use flow into the bore 134 of the deflector member 106. The control pin/groove arrangement also places the deflector member 106 in a position spaced from the shoulder 124. The groove may however be arranged so that the deflector member 106 abuts the shoulder 124 in both the open and closed positions. It will also be understood that the cyclical type of pin/groove arrangement of the first downhole tool 2 may be employed with the second tool 102.

During operation of each of the aforementioned tools 2,102 shown in the accompanying drawings, it will be understood that the deflector member may be arranged in a closed position when a deflecting of downhole equipment through the lateral window and into an adjacent lateral borehole is not desired. With the deflector member in the closed position, an accidental deflection by the deflector member of downhole equipment will result in said equipment engaging the interior of the body member. This engagement will prevent further downhole movement of the equipment and provide a clear indication at the surface of the undesired deflection. However, provided the equipment diameter is less than the reduced bore diameter of the deflector member, the equipment should pass into the primary borehole below the primary/lateral junction. When a deflection of equipment into a lateral borehole is required, the deflector member is arranged in the open position.

The present invention is not limited to the specific embodiments described above. Alternative arrangements will be apparent to a reader skilled in the art. For example, the tool body may be an integral part of a wellbore casing. Also, the bore of the deflector member may be provided with a helical groove which, when exposed to a flow of fluid, generates a rotary force which assists in rotating the deflector member. This arrangement may obviate the need to physically manipulate the deflector member with a gripping tool. In a further alternative arrangement, biasing means may be provided for returning the deflector member to one of the open and closed positions. The biasing means may, for example, comprise a spring or compressed gas. Thus, in use of apparatus comprising such an arrangement, the application of fluid pressure to the deflector member can move the deflector member downhole relative to the apparatus body into an open position. On release of fluid pressure, the deflector member will be pressed uphole relative to the apparatus body by the biasing means. Uphole movement of the deflector member from the open position may be prevented by a suitable latch type of mechanism as previously described in relation to the control pin and groove arrangement. The application of a required fluid pressure to the deflector member may be facilitated through the use of a frangible drop ball. When introduced into the apparatus string and received on a shoulder in the deflector member, the drop ball will allow the fluid pressures typically applied within the string to generate sufficient force to move the deflector member from its initial position to an open or closed position. The frangible ball may be removed from the apparatus (perhaps so as to reopen the deflector member bore and allow the running of further apparatus therethrough) by further increasing the fluid pressure and fracturing the drop ball into fragments sufficiently small to pass through the apparatus bore. The further increased fluid pressure may be sufficiently low to not move the deflector member once the frangible drop ball has been disintegrated. A suitable drop ball is described in UK Patent No 2,311,316 and the disclosure thereof is incorporated herein by reference.

Movement of the deflector member between open and closed positions may be restricted through use of a hydraulic actuation system dedicated to moving the deflector member. With such a system, the previous arrangement of a pin and groove is not necessarily required. The dedicated hydraulic system may comprise one or more hydraulic control lines extending from the surface to actuation means for moving the deflector member. The or each control line may be run separately from the main bore of the apparatus and may, for example, operate a motor for rotating the deflector member between open and closed positions. Indeed, the or each control line may direct hydraulic fluid to any suitable device for converting fluid pressure into either longitudinal or rotational movement, or a combination of both movements, so that open or closed deflector member positions may be selected as required. With appropriate pressure activated valves, a single hydraulic control line extending from the surface may be used. A person skilled in the art will be familiar with suitable hydraulic systems for generating the required deflector member movement, although use of such systems will not, it is believed, be known in the context of deflector member opening and closing apparatus.

Figure 7:
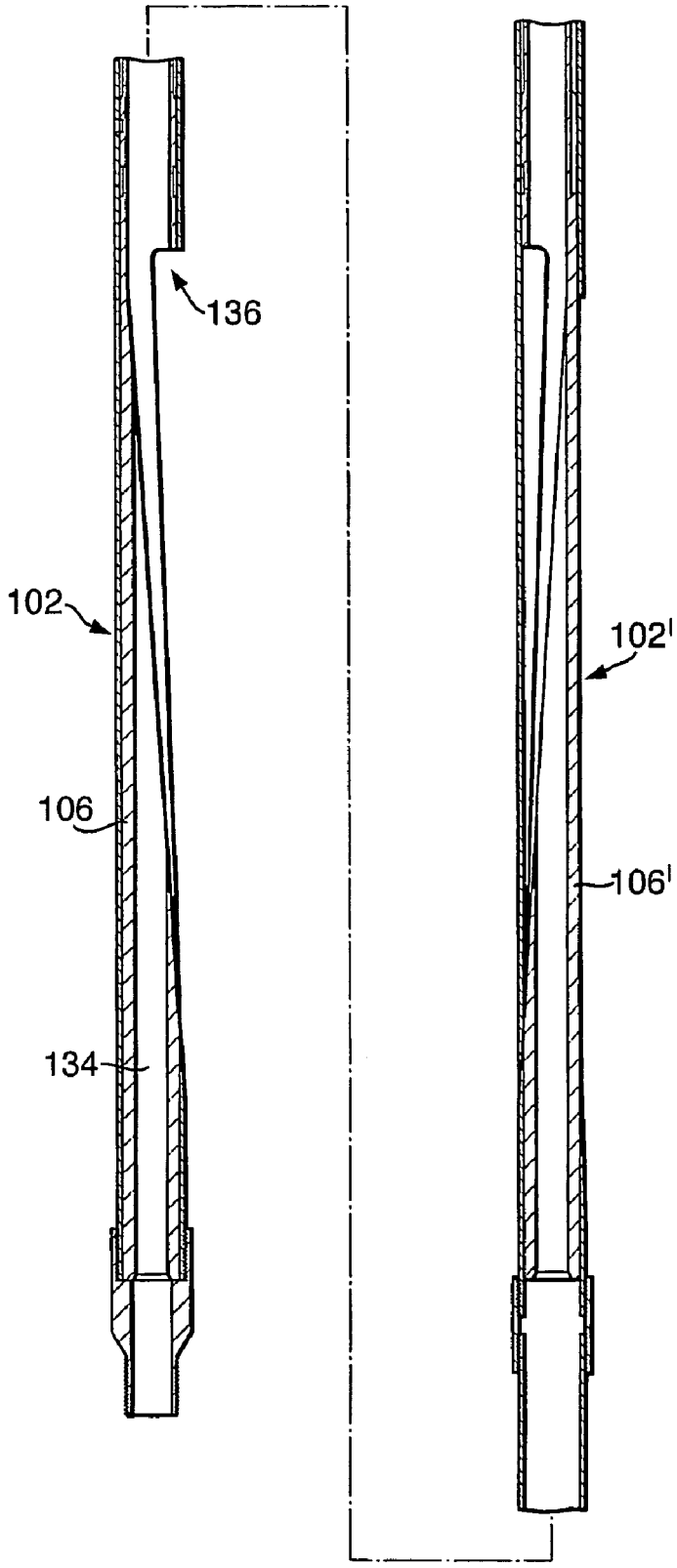
FIG. 7 is a cross-sectional side view of two embodiments as shown in FIGS. 5 and 6 connected to one another.

It will be apparent to the skilled person that the present invention may be used to independently open and close multiple lateral windows extending through a primary borehole. By way of example, FIG. 7 of the accompanying drawings shows a downhole assembly comprising the tool 102 of FIGS. 5 and 6 connected to the uphole end of a further tool 102' of FIGS. 5 and 6. In FIG. 7, the uphole tool 102 is shown with the deflector member 106 arranged in an open position. The lower tool 102' is shown with the deflector member 106' arranged in a closed position. The two deflector members 106,106' may be individually moved between open and closed positions by, for example, physical manipulation with an appropriate gripping tool. In this regard, a string to be run through either the primary borehole or the lateral borehole may be provided with a leading head which has an expandable diameter. The head diameter may be expandable through use of one or more circumferential elastomeric rings which may be radially displaced through the axial displacement of abutting cam surfaces. The cam surfaces may be axially moved by, for example, a hydraulic actuation system.

Figure 8:
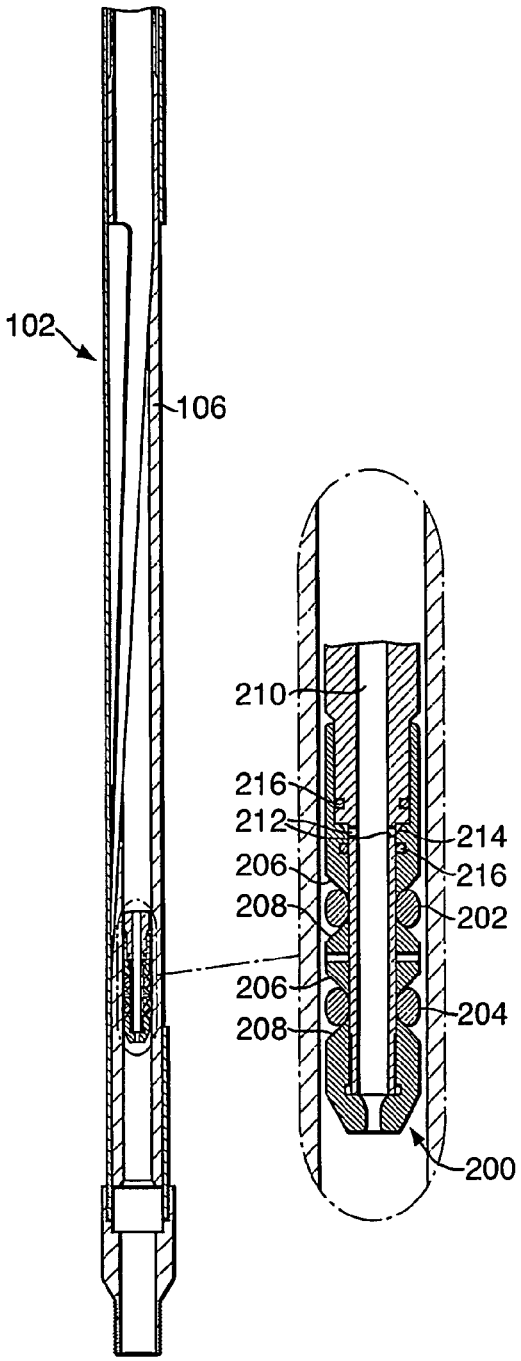
FIGS. 8 and 9 are cross-sectional side views of an expandable head tool located in the deflector bore of the second embodiment arranged in closed and open configurations respectively, the expandable head tool being shown passing through to a primary borehole.
Figure 9:
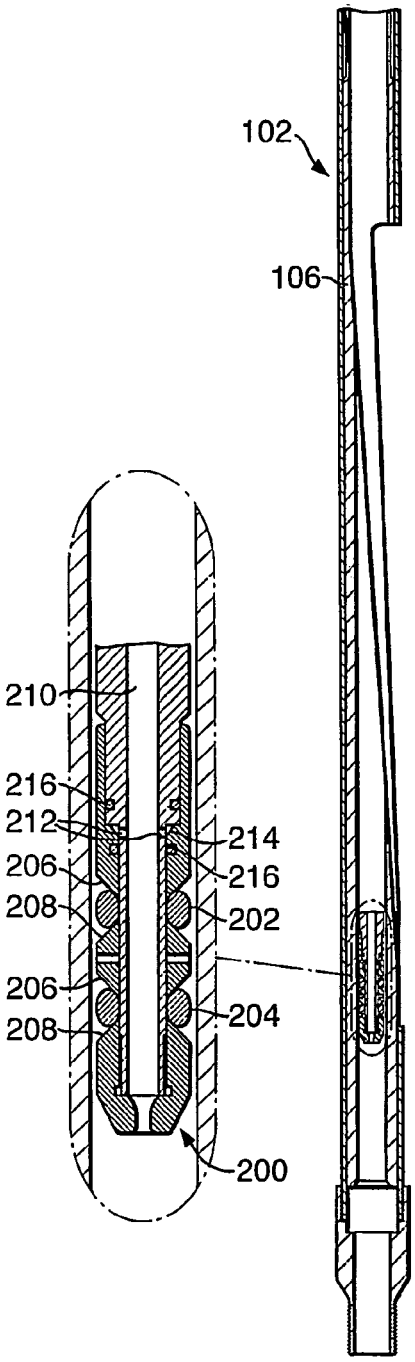

In FIGS. 8 and 9, an expandable head tool 200 is shown in an unexpanded state passing through the deflector bore of a deflector member in closed and open positions respectively. In each Figure, the deflector member is that of the second embodiment shown in FIGS. 5 and 6. It will be understood that the expandable head tool 200 comprises two elastomeric rings 202,204 which may be moved radially by the relative movement of camming surfaces 206,208 located on either side of each ring 202,204. Relative axial movement of said camming surfaces 206,208 is achieved by pumping fluid from a bore 210 in said expandable head tool 200, through apertures 212, and into an annular chamber 214. Fluid leakage from the chamber 214 is prevented by appropriate ring seals 216.

Figure 10:
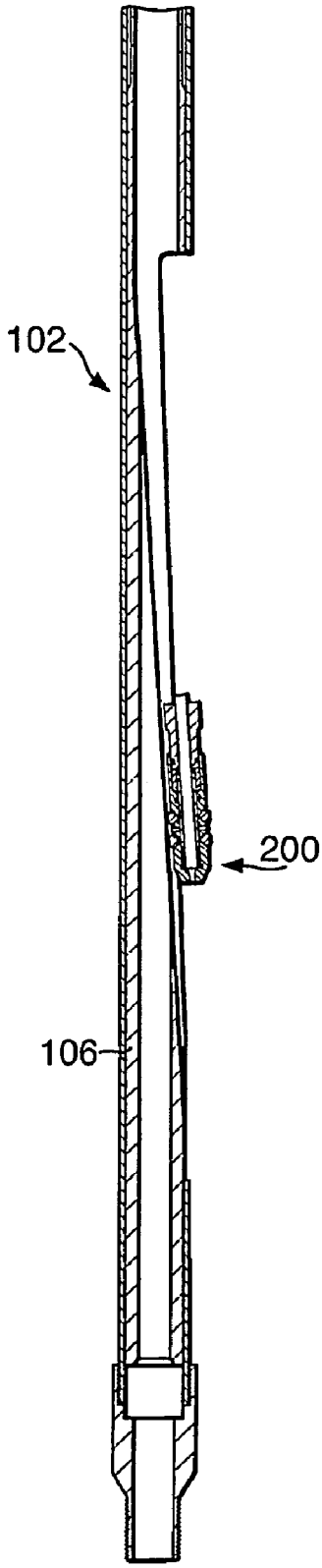
FIG. 10 is a cross-sectional side view of the expandable head tool of FIGS. 8 and 9 shown in an expanded configuration and being deflected through a lateral window.

As fluid is pumped into the chamber 214 of the expandable head tool 200, the camming surfaces 206,208 move relative to one another so as to radially expand the two elastomeric rings 202,204. The geometry of the expandable head tool 200 may be such that, when the rings 202,204 are expanded whilst the tool 200 is located uphole of the deflecting surface of the deflector member 106, the rings 202,204 remain radially spaced from the internal diameter of the deflector member but, when pushed downhole through the deflector bore, the rings 202,204 engage the ramp surface provided by the reduction in the deflector bore diameter and thereby force the tool 200 through the lateral window (see FIG. 10 of the accompanying drawings). In other words, when expanded, the rings 202,204 have an external diameter less than the larger internal diameter of the deflector bore but greater than the reduced internal diameter of the deflector bore. Thus, whether the expandable head tool 200 is run through the primary borehole or the lateral borehole may be conveniently determined by selectively expanding the elastomeric rings 202,204. The elastomeric nature of the rings 202,204 allows the tool 200 to return to its original smaller diameter when fluid is released from the fluid chamber 214.

Figure 11:
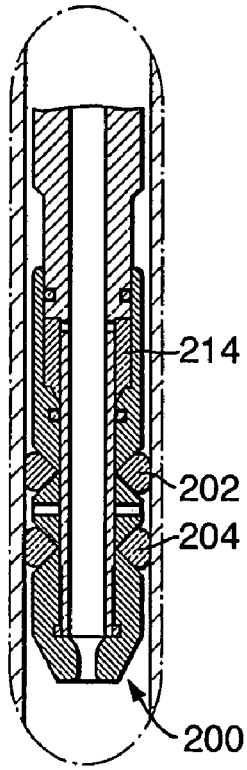
FIG. 11 is a cross-sectional side view of the expandable head tool of FIGS. 8 and 9 shown in an expanded configuration gripping a reduced diameter deflector bore.

It will be understood that the expandable head tool 200 may be used to grip the reduced diameter deflector bore, as shown in FIG. 11, and subsequently manipulate the deflector between open and closed positions. This operation may be assisted by providing the deflector bore with a specific profile into which the tool 200 (or the rings 202,204 thereof) may latch. Furthermore, by appropriately expanding the rings 202, 204, the tool 200 may be used to anchor equipment within the primary or lateral boreholes. This may be of use in jetting operations for example.

In circumstances where use of the section of primary borehole located downhole of the primary/lateral junction is not required, a solid deflector sub 300 may be secured adjacent the lateral window in the reduced diameter portion of the deflector bore so as to block the deflector bore and form (together with the deflector surface) a ramp with which equipment may be deflected through the lateral window. The deflecting ramp thereby formed will tend to be more robust than that formed by the deflector surface 126 alone.

Figure 12:
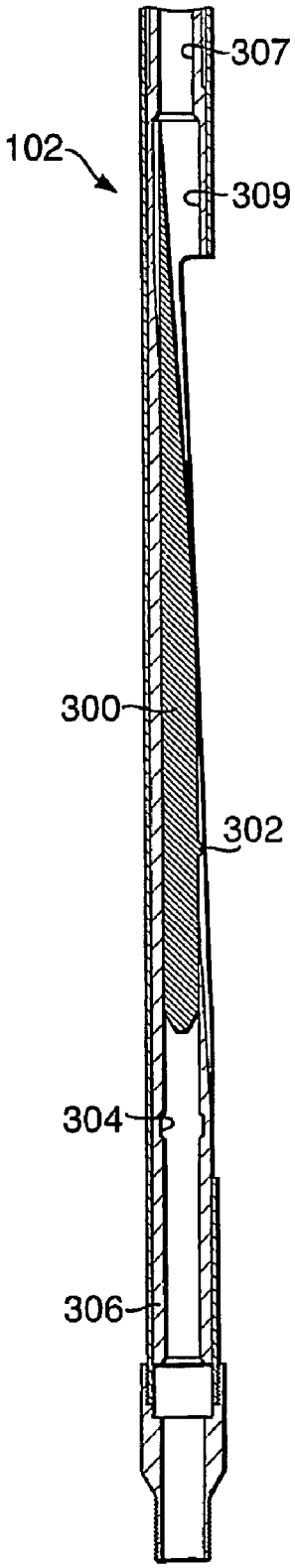
FIGS. 12 and 13 are cross-sectional side views of a solid deflector sub respectively located in unlatched and latched positions within a reduced diameter deflector bore.

The sub 300 is provided with latching means 302 for locating in a suitable profile 304 in the reduced diameter deflector bore. This profile may be that used in conjunction with the aforementioned expandable head tool 200. A profile may also be provided within the reduced diameter deflector bore for appropriately orienting the sub 300 relative to the lateral window. The latching means 302 preferably comprises radially expandable elements which may be retracted so as to allow passage of the sub 300 through the reduced diameter deflector bore. FIG. 12 shows the sub 300 being run into the reduced diameter deflector bore, whilst FIG. 13 shows the sub 300 latched within the reduced diameter deflector bore to provide a robust deflecting surface.

Figure 13:
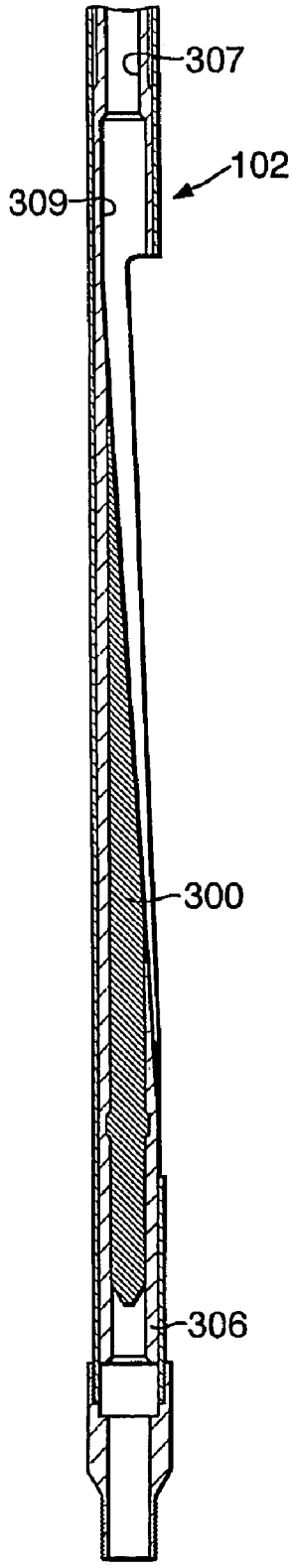

It will also be seen with reference to FIGS. 12 and 13 that, uphole of the deflector surface provided on the deflector member 306, the deflector member defines a further reduced diameter bore 307 in which the expandable head tool 200 may be expanded and thereby readily grip the deflector member 306 for subsequent manipulation. A larger diameter bore 309 is located between the two reduced diameter bores. With the expandable head tool 200 positioned in the larger bore 309, the tool 200 may be expanded without gripping (or without significantly gripping) the deflector member so that, when subsequently pressed downhole, the tool 200 is deflected by the deflector surface and directed through the lateral opening.

Figure 14:
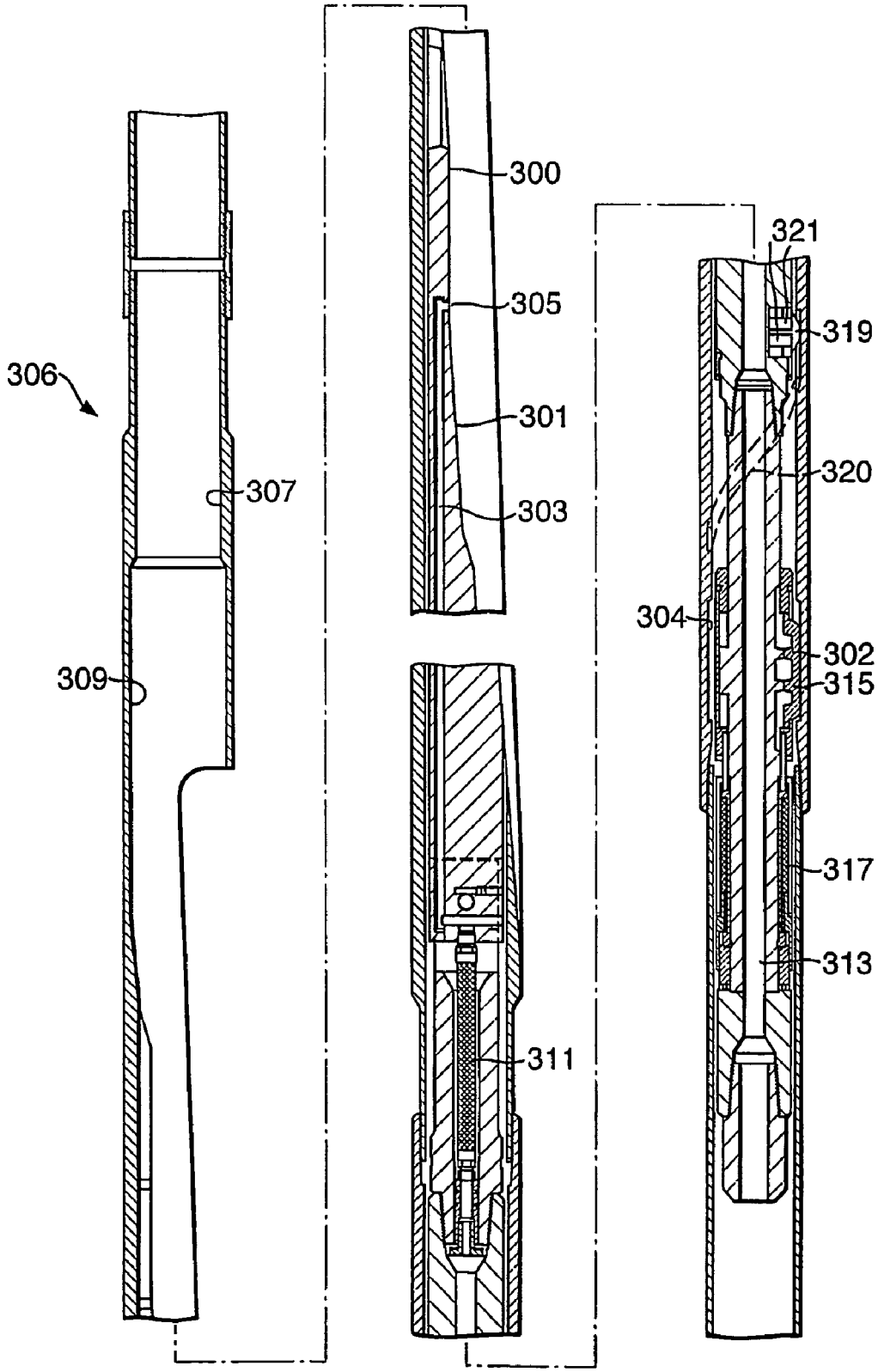
FIG. 14 is a detailed cross-sectional side view of the solid deflector sub of FIGS. 12 and 13 latched to a deflector member.

The deflector member 306 and solid deflector sub 300 of FIGS. 12 and 13 are shown in greater detail in FIG. 14 of the accompanying drawings. It will be seen that the solid deflector sub 300 comprises a ramp portion 301 for deflecting wellbore equipment. The ramp portion 301 has a longitudinally extending hydraulic line 303 located therein which has an opening 305 onto the surface of the ramp portion 301. The hydraulic line 303 communicates with further hydraulic passages 311, 313 so that the portion of primary borehole located uphole of the sub 300 may hydraulically communicate with the portion of primary borehole located downhole of the solid deflector sub 300. The latching means 302 comprises three latching members 315 (only one of which is shown in FIG. 14) which are biased by means of a spring 317 towards a radially expanded position. Once the latching means 302 locates adjacent the profile 304, the latching members 315 have sufficient room to be pressed by the spring 317 into a locked radially expanded position as shown in FIG. 14. Orientation of the solid deflector sub 300 is achieved by locating a radially extendable locating pin 319 into an orienting profile 320 and pulling the solid deflector sub 300 uphole. As the sub 300 is pulled uphole, the pin 319 runs within the orienting profile 320 and thereby rotates the ramp portion 301 to the desired angular position. The pin 319 is itself biased radially outwardly into the orienting profile 320 by means of two springs 321.

The deflector member 306 does not necessarily need to be used as the moveable portion shown in FIGS. 12 and 13. The deflector member 306 may be used in isolation with or without the solid deflector sub 300. The deflector member 306 may be used as part of a casing string and may be used to particular advantage with an expandable head tool so as to provide selective lateral entry.

The deflector member in any of the aforementioned tools may be cycled uphole and downhole between lateral window open and closed positions through use of the downhole manipulation tool 400 shown in FIGS. 15 to 23 of the accompanying drawings. The manipulation tool 400 comprises a fluid diverter sub 402 and a latch sub 404. The latch sub 404 is connected to the downhole end of the fluid diverter sub 402 by means of a screw thread connection. With reference to the accompanying drawings, it will be seen that a longitudinal bore 406 extends axially through the length of the manipulation tool 400 so that wellbore fluid may be pumped from one end of the tool 400 to the distal end thereof.

Figure 20:
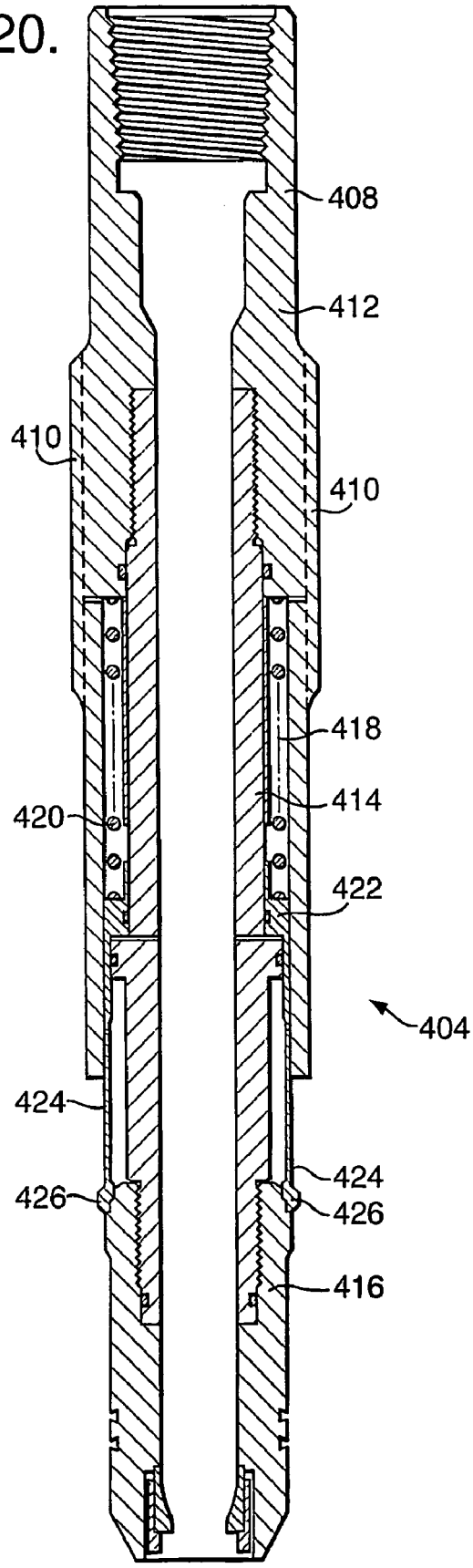
FIG. 20 is an enlarged cross-sectional side view of a latch sub of the manipulation tool of FIG. 15.

The latch sub 404 of the manipulation tool 400 is shown in greater detail in FIG. 20 of the accompanying drawings. The latch sub 404 functions to allow the manipulation tool to engage with an uphole end of a deflector member and thereby enable an uphole pull to be applied to the deflector member. With particular reference to FIG. 20, it will be seen that the latch sub 404 comprises a generally cylindrical body 408 having circumferentially spaced stabiliser arms 410 extending radially therefrom. The body 408 is made up of three generally cylindrical components 412,414,416 screw threadedly connected to one another. The first and second body components 412,414 define an annular chamber 418 in which a helical spring 420 is located. One end of a cylindrical collett member 422 is also trapped within the chamber 418 and is biased by means of the spring 420 towards a downhole end of the chamber 418. Collett fingers 424 extend axially from the trapped end of the collett member and are retained in a radial position by virtue of their abutment with the third body component 416. However, it will be appreciated with reference to FIG. 20 that axial movement of the collett member 422 against the bias of the spring 420 will allow the collett fingers 424 to become spaced from the third body component 416 and this in turn will allow the collett fingers 424 to be displaced radially inwardly.

In use of the manipulation tool 400, the latch sub 404 is located within the uphole end of a deflector member. As the third body component 416 is run into the bore of the deflector member, radially extending end portions 426 of each collett finger 424 engage the deflector member and, as a consequence, the collett member is pressed uphole against the bias of the spring 420. This uphole movement of the collett member allows the collett fingers 424 to be cammed radially inwardly by the deflector member. The collett fingers 424 may then move axially downhole relative to the deflector member and locate in a circumferential groove 500 (see FIG. 15) provided in the bore of the deflector member. As the collett fingers 424 snap into the groove 500 of the deflector member, said fingers 424 re-engage with the third body component 416. In so doing, the collett fingers 424 move radially outwardly and are retained in this position by the third body component 416. The ends 426 of the collett fingers 424 then become trapped within the groove 500 and this allows an uphole force to be applied to the deflector member upon an uphole pull on the manipulation tool 400. Circumferential seals may be provided on the third body component 416 so as to prevent fluid flow between the exterior of the third body component 416 and the bore of the deflector member.

Figure 21:
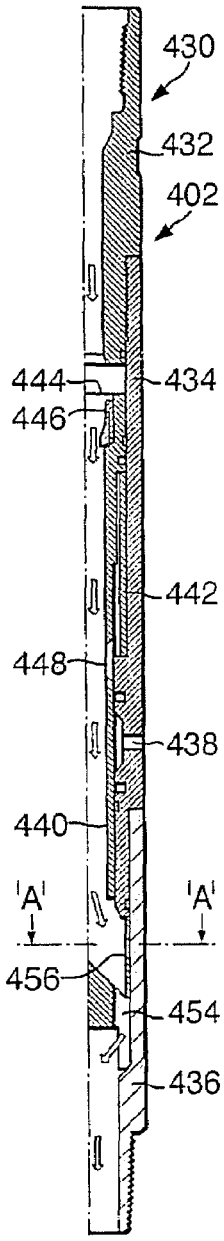
FIG. 21 is a cross-sectional partial side view of the manipulation tool of FIG. 15 arranged so as to direct all fluid flowing therethrough axially downhole.
Figure 23:
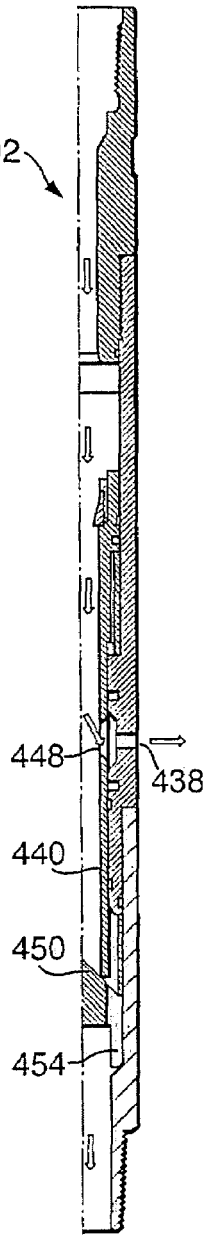
FIG. 23 is a cross-sectional partial side view of a manipulation tool arranged so as to divert all fluid flowing downhole therethrough via vent apertures into a surrounding annulus.

An enlarged view of the fluid diverter sub 402 is shown in FIGS. 21 and 23 of the accompanying drawings. The fluid diverter sub 402 comprises a cylindrical body 430 made up of three body components 432,434,436. The first body component 432 is screw threaded to the uphole end of the second body component 434 and the third body component 436 is screw threaded to the downhole end of the second body component 434. The second body component 434 is provided with a plurality of laterally extending vent apertures 438 which project through the wall of the latch sub 404 and allow for fluid communication between the exterior of the latch sub 404 and a bore extending axially therethrough. A cylindrical piston 440 is located in the region of the vent apertures 438 for axial movement within the body 430. The piston is biased by means of a spring 442 uphole into abutment with a circlip 444. A nozzle 446 is secured within the bore of the piston 440 at an uphole end thereof so as to allow a downhole flow of fluid through the fluid diverter sub 402 to move the piston 440 axially downhole against the uphole bias of the spring 442.

In FIG. 21, the fluid diverter sub is shown with the piston 440 located in a first position in which the spring 442 presses the uphole end of the piston 440 against the circlip 444. In this first position, the piston 440 covers the vent apertures 438 and prevents a flow of fluid therethrough. However, if the flow of fluid is increased, the bias of the spring 442 may be overcome and the piston 440 may be moved axially downhole relative to the body 430 so that a plurality of apertures 448 in the wall of the piston 440 are in fluid communication with the vent apertures 438 of the diverter sub body 430. It will be understood that fluid may then flow from the bore of the fluid diverter sub 402 to the annulus surrounding the sub 402 via the apertures 448,438. Indeed, when in this second position as shown in FIG. 23, the piston 440 locates at its downhole end in abutment with a cone portion 450. The cone portion 450 operates to seal the bore extending through the piston 440 thereby preventing a flow of fluid through the full length of the fluid diverter sub 402. As a consequence, all fluid flowing into the diverter sub 402 must exit the diverter sub 402 through the vent apertures 438 when the piston 440 is in the second position as shown in FIG. 23.

Figure 21A:
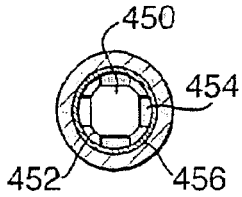
FIG. 21A is a cross-sectional view taken along line A-A of FIG. 21.
Figure 22:
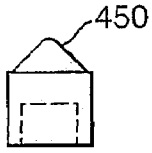
FIG. 22 is a first side view of a diverter valve of the manipulation tool.
Figure 22A:
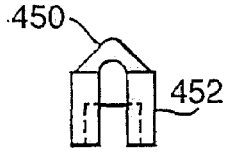
FIG. 22A is a second side view of the diverter valve of FIG. 22 rotated through 90°.
Figure 22B:
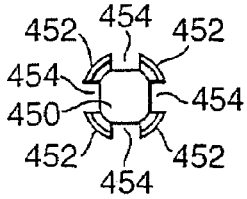
FIG. 22B is a too view of the fluid diverter of FIG. 22.

Perhaps as best illustrated in FIG. 21A, the cone portion 450 is located centrally within the bore of the fluid diverter sub 402 downhole of the piston 440 by means of four radially extending arms 452. The arms 452 are equi-spaced about the cone portion 450 and define axial fluid flow passages 454 therebetween which allow fluid to flow through the full length of the diverter sub 402 when the piston 440 is in the first position. The cone portion 450 and the arms 452 are integrally formed as a single item which is retained against an uphole facing shoulder in the bore of the body component 436 by a cylindrical sleeve 456. The sleeve 456 is itself pressed downhole onto the arms 452 by the second body component 434.

Figure 15:
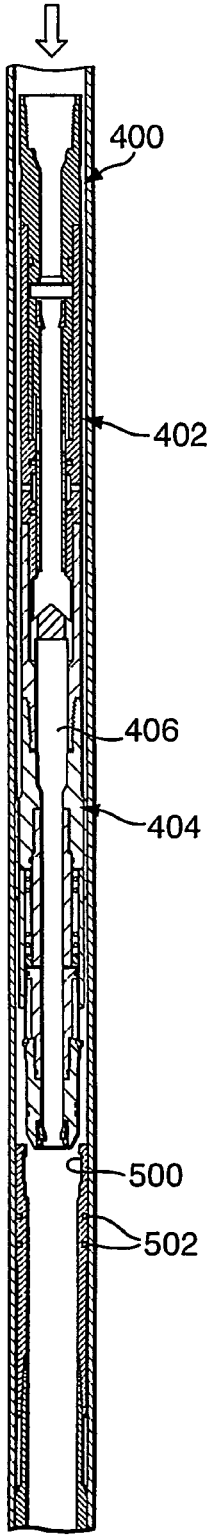
FIG. 15 is a cross-sectional side view of a manipulation tool being run down a primary borehole.
Figure 16:
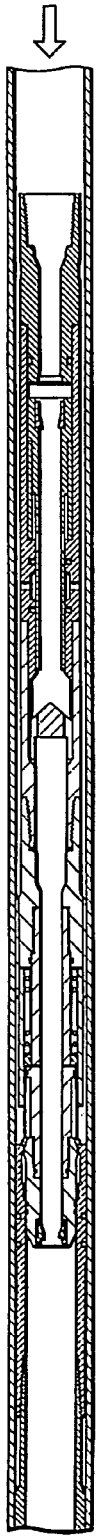
FIG. 16 is a cross-sectional side view of the manipulation tool of FIG. 15 being run into the deflector member of a downhole deflector tool.
Figure 17:
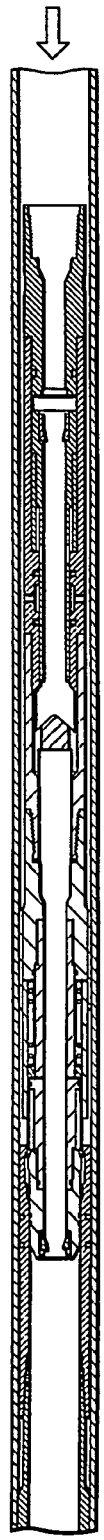
FIG. 17 is a cross-sectional side view of the manipulation tool of FIG. 15 being engaged with the deflector member of FIG. 16.
Figure 18:
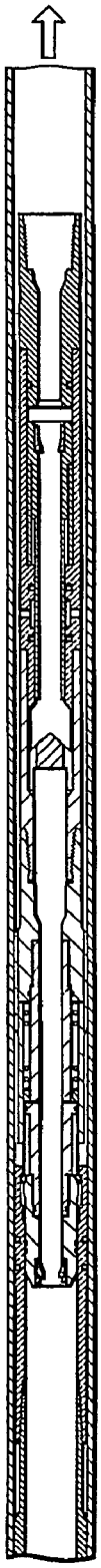
FIG. 18 is a cross-sectional side view of the manipulation tool of FIG. 15 being pulled uphole so as to apply an uphole force on the deflector member of FIG. 16.
Figure 19:
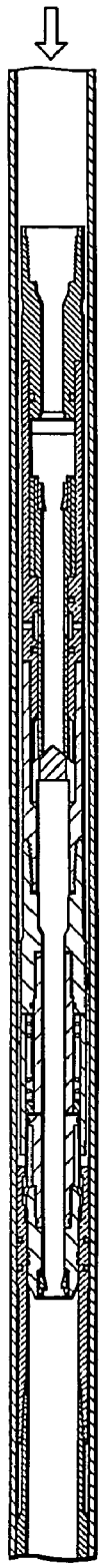
FIG. 19 is a cross-sectional side view of the manipulation tool of FIG. 15 arranged so as to deflect a downhole flow of fluid through said tool laterally through vent apertures into a surrounding annulus.

In use of the manipulation tool, the latch sub 404 is snap fitted into the circumferential groove 500 of the deflector member whilst the fluid diverter sub 402 is located with the piston 440 in the first position (see FIGS. 15 to 17). The deflector member may then be cycled uphole and downhole so as to open and close a lateral window by pulling uphole on the manipulation tool 400 (so as to move the deflector member uphole) and by venting fluid through the vent apertures 438 (so as to move the deflector member downhole). With regard to the moving of the deflector member in a downhole direction, it will be understood that by moving the piston to the second position, a flow of fluid past the deflector member is prevented. This is due to the engagement of the piston 440 with the cone portion 450, the seal between the third latch sub body component 416 and the bore of the deflector member, and also by virtue of circumferential fluid seals 502 (see FIG. 15) between the exterior surface of the deflector member and the body of the downhole deflector tool in which the deflector member axially moves. In fact, when the manipulation tool 400 is engaged with the deflector member and vents fluid to the annulus, the manipulation tool 400 and deflector member together act as a piston which may be driven downhole by means of fluid pressure. Once the deflector member has been moved downhole to the required extent, the deflector member may be pulled uphole by pulling on the manipulation tool (which potentially may remain in the venting configuration). This process may be repeated until the deflector member has been cycled to the required position in which a lateral window is either opened or closed.

The present invention is not limited to the specific embodiments described above. Alternative arrangements will be apparent to a reader skilled in the art. For example, tools such as a spear may be located in the uphole end of the deflector member in order to allow manipulation thereof. The manipulation tools may be run on a drill string or coil tubing.

In circumstances where a plurality of lateral boreholes are provided along the length of a primary borehole, a plurality of deflector tools may be stacked within the primary borehole and operated independently of one another to selectively open or close the lateral boreholes as required. The manipulation tool 400 is sized in such a way as to prevent it from passing through the bore of a deflector member. In this way, its "no-go" characteristic allows a downhole force to be transferred from the manipulation tool to the deflector member. However, if a single manipulation tool is to be used to manipulate deflector members of tools located in a stack downhole of the uppermost deflector tool, then the manipulation tool 400 must be modified so that the "no-go" facility may be activated and deactivated. This may be achieved by means of locking dogs which may be selectively locked in a radially extended position. In this way, the dogs may be retracted to allow a manipulation tool to pass through the bores of upper deflector members and then be locked in a radially extended position when engaged with the fishing neck groove profile of a deflector member associated with a lateral borehole to be open or closed. The dogs may be locked in a radially extended position by means of a fluid pressure activated mechanism (eg a piston).

A manipulation tool modified as described above can be used to close successive lateral boreholes in a downhole direction. It will be understood that, in order to pressurize the annulus and stroke a deflector member in a downhole direction by means of the manipulation tool, lateral boreholes located uphole of the manipulation tool must be sealed so that fluid is not pumped down those lateral boreholes rather than pressuring the annulus and forcing the manipulation tool and deflector member downhole.

The invention claimed is:

1. A downhole deflector tool which is removably insertable into a wellbore for selectively opening and closing a lateral wellbore extending from a wellbore, the downhole tool comprising:

a body incorporating a wall provided with an opening extending therethrough;

a hollow tubular deflector member slidably mounted in the body and having a deflecting surface for deflecting, in use, downhole equipment laterally within the body, the deflector member being slidable between an open position, in which the deflecting surface is located adjacent and facing towards said body opening so that, in use, downhole equipment laterally deflected by the deflecting surface is directed through said body opening, and a closed position, in which the deflector member is oriented relative to said body opening so as to prevent downhole equipment from being laterally deflected through said body opening during use; and constraining means for restricting movement of the deflector member relative to the body.

2. The downhole tool as claimed in claim 1, wherein the constraining means comprises a pin and groove arrangement, in which at least one pin is secured to one of the body and deflector member for locating in the groove defined in the other of the body and deflector member.

3. The downhole tool as claimed in claim 2, wherein the pin and groove arrangement is such that the deflector member must move axially between two different closed positions before being able to move axially to the open position.

4. The downhole tool as claimed in claim 1, wherein the constraining means comprises a shoulder defined by the body and against which the deflector member abuts when in the open position.

5. The downhole tool as claimed in claim 1, wherein the bore hollow interior of the deflector member comprises first and second portions, the first portion having a larger diameter than the second portion, and wherein the deflecting surface is defined on that portion of the deflector member which defines the second portion of the hollow interior.

6. The downhole tool as claimed in claim 1, wherein sealing means are provided between the body and the deflector member so that, when in the closed position, fluid located exteriorly of the body is prevented from flowing into the bore of the deflector member.

7. The downhole tool as claimed in claim 1, wherein, in the closed position, the deflecting surface of the deflector member faces diametrically away from said opening.

8. The downhole tool as claimed in claim 1, wherein, in the closed position, the deflecting surface is axially spaced from said opening.

9. A downhole tool which is removably insertable into a wellbore for selectively opening and closing a lateral wellbore extending from a wellbore, the downhole tool comprising:

a body incorporating a wall provided with an opening extending therethrough;

a hollow tubular deflector member slidably mounted in the body and having a deflecting surface for deflecting, in use, downhole equipment laterally within the body, the deflector member being slidable between an open position, in which the deflecting surface is located adjacent and facing towards said body opening so that, in use, downhole equipment laterally deflected by the deflecting surface is directed through said body opening, and a closed position, in which the deflector member is oriented relative to said body opening so as to prevent downhole equipment from being laterally deflected through said body opening during use; and constraining means for restricting movement of the deflector member relative to the body wherein, in the closed position, said opening is completely covered by the deflector member.

10. A method of using a down hole deflector tool which is removably insertable into a wellbore, the deflector tool including a body incorporating a wall provided with an opening extending therethrough; a hollow tubular deflector member slidably mounted in the body and having a deflecting surface for deflecting, in use, downhole equipment laterally within the body, the deflector member being slidable between an open position, in which the deflecting surface is located adjacent and facing towards said body opening so that, in use, downhole equipment laterally deflected by the deflecting surface is directed through said body opening, and a closed position, in which the deflector member is oriented relative to said body opening so as to prevent downhole equipment from being laterally deflected through said body opening during use; and constraining means for restricting movement of the deflector member relative to the body; the method comprising the steps of running said tool down a wellbore, aligning said opening of said tool body with a lateral borehole extending from said wellbore, and selectively moving said deflector member between said open and closed positions.

11. A downhole tool which is removably insertable into a wellbore for selectively opening and closing a lateral wellbore extending from a wellbore, the downhole tool comprising:

a body incorporating a wall provided with an opening extending therethrough;

a hollow tubular deflector member slidably mounted in the body and having a deflecting surface for deflecting, in use, downhole equipment laterally within the body, the deflector member being slidable between an open position, in which the deflecting surface is located adjacent and facing towards said body opening so that, in use, downhole equipment laterally deflected by the deflecting surface is directed through said body opening, and a closed position, in which the deflector member is oriented relative to said body opening so as to prevent downhole equipment from being laterally deflected through said body opening during use;

constraining means for restricting movement of the deflector member relative to the body, and a downhole manipulation tool comprising a generally cylindrical body having a bore axially extending therethrough and a vent aperture laterally extending therethrough so as to allow fluid communication between the bore of the manipulation tool and the exterior thereof; the manipulation tool further comprising a piston movable within the bore of the manipulation tool between a first position, in which the vent aperture is closed, and a second position, in which the vent aperture is open and the bore of the manipulation tool is blocked so that, in use, all fluid flowing through the bore of the manipulation tool is directed through the vent aperture.

12. The downhole tool as claimed in claim 11, wherein the bore of the deflector member is provided with a circumferential groove and the body of the manipulation tool is provided with a collett for engaging with said circumferential groove.

13. A method of using (1) a downhole deflector tool which includes a body opening and closing a lateral borehole extending from a wellbore, incorporating a wall provided with an opening extending therethrough; a hollow tubular deflector member slidably mounted in the body and having a deflecting surface for deflecting, in use, downhole equipment laterally within the body, the deflector member being slidable between an open position, in which the deflecting surface is located adjacent and facing towards said body opening so that, in use, downhole equipment laterally deflected by the deflecting surface is directed through said body opening, and a closed position, in which the deflector member is oriented relative to said body opening so as to prevent downhole equipment from being laterally deflected through said body opening during use; and constraining means for restricting movement of the deflector member relative to the body, and (2) a downhole manipulation tool which includes a generally cylindrical body having a bore axially extending therethrough and a vent aperture laterally extending therethrough so as to allow fluid communication between the bore of the manipulation tool and the exterior thereof; the manipulation tool further comprising a piston movable within the bore of the manipulation tool between a first position, in which the vent aperture is closed, and a second position, in which the vent aperture is open and the bore of the manipulation tool is blocked so that, in use, all fluid flowing through the bore of the manipulation tool is directed through the vent aperture; the method comprising the steps of running the downhole deflector tool down a wellbore, aligning said opening of the body of the downhole deflector tool with a lateral borehole extending from said wellbore, running the downhole manipulation tool down said wellbore, and applying fluid pressure to the manipulation tool so as to move the piston of the manipulation tool from the first position to the second position whilst the body of the manipulation tool is engaged with the deflector member of the down hole deflector tool.

14. The method as claimed in claim 13, wherein the downhole manipulation tool is run down said wellbore while engaged with the down hole deflector tool.

* * * * *